United States Patent [19]

Parthasarathi

[11] Patent Number: 4,545,178

[45] Date of Patent: Oct. 8, 1985

[54] CHOPPER FOR AN ENVELOPE STUFFING MACHINE

[75] Inventor: Thiruvenkata R. Parthasarathi, Chicago, Ill.

[73] Assignee: Compmail Systems, Inc., Addison, Ill.

[21] Appl. No.: 561,674

[22] Filed: Dec. 15, 1983

[51] Int. Cl.[4] ..... B65B 63/00

[52] U.S. Cl. ..... 53/435; 53/266 A; 53/460; 53/520; 53/562; 412/1; 412/9

[58] Field of Search ..... 53/206, 209, 244, 266 A, 53/429, 435, 460, 513, 520, 562, 569; 83/382, 389, 460, 925 A; 412/1, 9

[56] References Cited

U.S. PATENT DOCUMENTS

| | | | |
|---|---|---|---|
| 1,086,391 | 2/1914 | Molyneux . | |
| 1,211,329 | 1/1917 | McMillan . | |
| 2,010,997 | 8/1935 | Jurgensen | 53/435 X |
| 2,736,999 | 3/1956 | Rouan et al. . | |
| 2,766,569 | 10/1956 | Strother et al. . | |
| 2,771,726 | 11/1956 | Owen et al. . | |
| 3,106,809 | 10/1963 | Forthmann | 53/520 X |
| 3,260,517 | 7/1966 | Sather . | |
| 3,271,022 | 9/1966 | Sather et al. . | |
| 3,466,833 | 9/1969 | Penrod et al. | 53/520 X |
| 3,753,330 | 8/1973 | Hujer et al. | 53/520 |
| 3,965,644 | 6/1976 | Stocker . | |
| 4,067,171 | 1/1978 | Herbert et al. | 53/460 X |

*Primary Examiner*—John Sipos
*Assistant Examiner*—Steven P. Weihrouch
*Attorney, Agent, or Firm*—Hill, Van Santen, Steadman & Simpson

[57] ABSTRACT

A conventional envelope stuffing machine is provided with a chopper of cutter for providing a stack of individual inserts from pre-connected booklets. The chopper operates in synchronism with the stuffing machine through the provision of a pair of simple cam-operated switches.

20 Claims, 8 Drawing Figures

CHOPPER FOR AN ENVELOPE STUFFING MACHINE

BACKGROUND OF THE INVENTION

1. Field of the Invention

The present invention relates to an envelope stuffing machine, and is more particularly concerned with apparatus for providing a multisheet insert, originally in the form of a booklet, for stuffing into an envelope.

2. Description of the Prior Art

As is well known in the art, envelope stuffing machines generally operate on a stepping principle in which one or more insert sheets are fed onto a conveyor and step toward a stuffing station. At the stuffing station, an envelope is stuffed onto a stuffing platform, opened and stuffed with the total insert which may comprise a plurality of sheets. One such machine is the Bell & Howell machine manufactured by the Bell & Howell Business Equipment Group and is designated by the model number A340-10. Another such machine is the model 9800 manufactured by Inserco Mfg. Inc. of Alsip, Ill.

SUMMARY OF THE INVENTION

Modern envelope stuffing machines provide that a plurality, say ten, individual inserts may be provided for a single envelope in a sequentially-operating system. There are times, however, when a certain customer wishes that a bundle of such sheets, forming an insert or a portion of an insert, be provided to addressees, in which the bundle has a different third, fourth or fifth sheet, compared to other bundles provided to the same group of addressees. In order to maintain the bundle of sheets, per addressee, together, and in order to be able to provide such a bundle to an addressee, it has been determined that such a bundle should be provided as a booklet with a stapled or gummed edge.

In order to accommodate the addressee in having individual sheets, however, for return coupons, request for information and the like, it has been found that it is not advisable to provide the bundle of sheets as a booklet to the addressee, but to provide individual sheets in order to increase response from the consumer. Therefore, from the standpoint of packaging, booklets are preferred, but from the standpoint of the consumer, individual sheets are preferred.

SUMMARY OF THE INVENTION

It is therefore the object of the present invention to provide multisheet inserts which are stuffed in envelopes as individual sheets and which, prior to stuffing, are provided as booklets.

According to the invention, the above object is achieved, by providing that booklets of the type described above are sequentially fed to a conveyor which steps the same toward a stuffing station. Between the feed of the booklets and the stuffing station, a chopper is provided to trim off the stapled or gummed edge of each booklet so as to provide the same as a multisheet insert.

In order that the trimming operation be accommodated to standard and conventional machines now on the market, the chopper or cutter is synchronized with the operation of the machine in a simple and advantageous manner.

According to particular features of the invention, a cutter is provided and operates within a machine cycle to trim off the bound edges of the booklet to provide a multisheet insert. The cutter comprises a stationary lower cutting blade, a movable upper cutting blade and a stop to determine the depth of cut. The vertical cut height is adjustable to accommodate different thickness of booklets and a position of the cutter is adjustable with respect to the convevor. Moving with the upper cutting blade, and cooperable with the lower cutting blade, is a resiliently mounted bar for holding the booklets prior to and during cutting.

In order to synchronize the operation of the cutter with the machine, a cam is connected to a spindle which operates in accordance with the cycle of the machine. The cam operates first and second switches to cause, via valves, the operation of a fluid-actuated cylinder for the cutting stroke and the release stroke.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
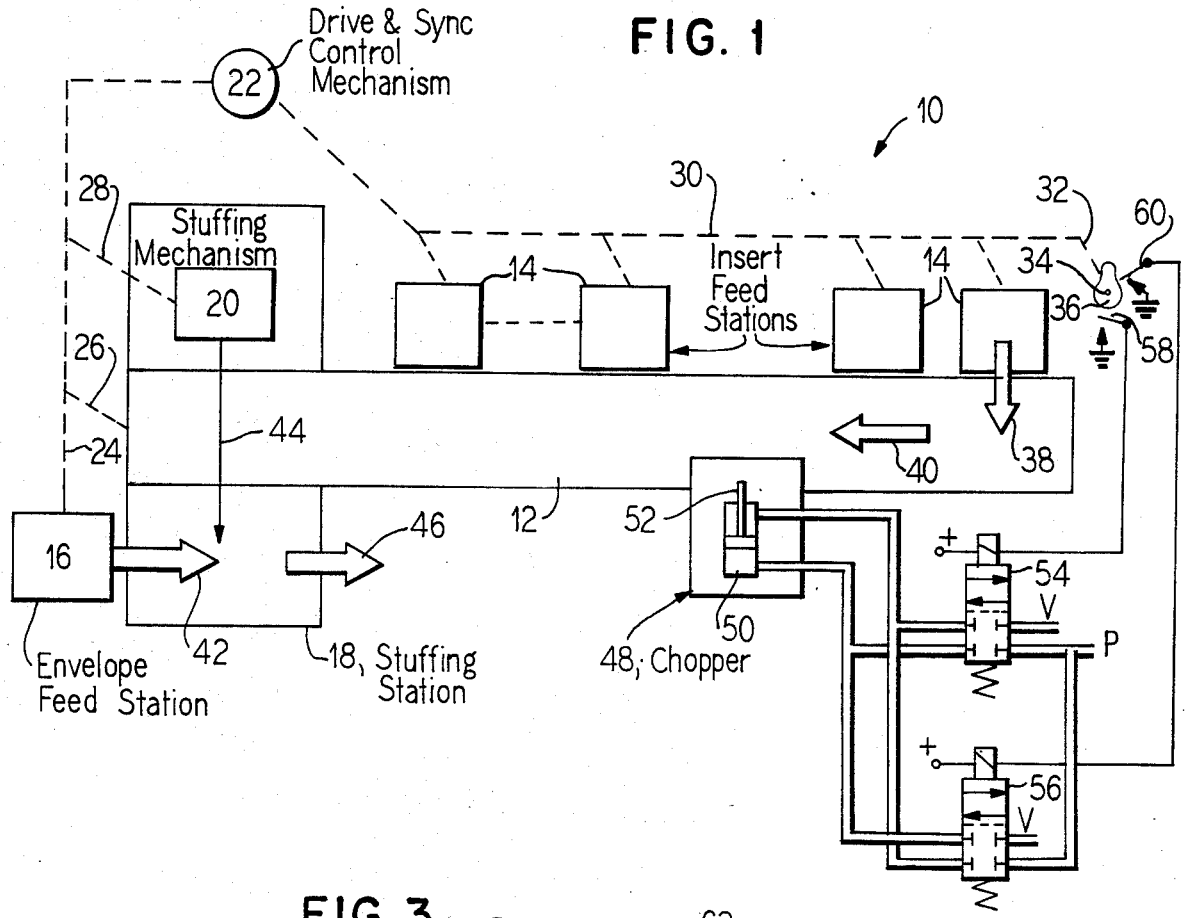
FIG. 1 is a schematic illustration of an envelope stuffing machine comprising a chopper constructed in accordance with the present invention.

Referring to FIG. 1, a known envelope stuffing machine is schematically illustrated and is adapted for the present invention. The stuffing machine is generally illustrated at 10 as comprising an elongate conveyor 12, a plurality of insert feed stations 14, an envelope feed station 16, and a stuffing station 18 including a stuffing mechanism 20. The machine is driven, conventionally by an electric motor, which motor may be included in a sink controlled mechanism 22. The control mechanism 22 is mechanically linked to all of the aforementioned elements and causes cyclic operation such that an insert and an envelope reach the stuffing station at the same time and the insert is then stuffed into the envelope. This is a cyclic, stepped operation. The control mechanism 22 is mechanically linked to the envelope feed station 16 and causes the same to cyclically feed envelopes to the stuffing station 18. A mechanical link 26 also causes stepped operation of the conveyor 12, while another mechanical link 28 causes cyclic operation of a stuffing mechanism 20. Each of the insert feed stations is controlled by a mechanical linkage 30 to cyclically feed individual inserts onto the conveyor 12. A further mechanical linkage 32 is provided for rotating a shaft or spindle 34 which carries a cam 36 for operating a pair of switches 60, 58 as will be explained in detail hereinbelow.

As indicated by the right-hand insert feed station 14, an insert is fed onto the conveyor 12 as indicated by an arrow 38, and then is stepped toward the left in a cycle in which the insert is stopped in front of each insert feed station and, if individual inserts are loaded into the feed stations, a pile of individual inserts is built up as the inserts travel towards the stuffing station 18. This stepping of the inserts along the conveyor 12 is indicated by the arrow 40.

The arrow 42 indicates the feeding of the envelopes from the envelope feed station 16 to the stuffing station 18. The arrow 44 symbolically represents a moving member, such as an extensible member, of the stuffing mechanism for moving the total insert into the envelope. The arrow 46 indicates a stepping of the stuffed envelope to further stations for sealing, stacking and the like by way of a further conveyor (not illustrated).

The above-discussed structure is conventional and well known in the art. Added thereto, for one to practice the present invention, is a cutting station 48 including a cylinder 50, such as a pneumatic cylinder, which is driven from a fluid source P, such as a compressed air supply, by way of a pair of valves 54, 56. Advantageously, the valves 54, 56 may be electrically-operated solenoid valves which are cyclically operated by way of the switches 58, 60.

As the cam 36 rotates, the switch 60 is first momentarily operated to operate the solenoid valve 56 and apply pressure therethrough to the upper portion of the cylinder 50 and provide a vent V for the lower portion of a cylinder 50. This causes the extensible member 52 to be moved inwardly and provide a down cutting movement of the apparatus described hereinbelow. As the cam further rotates and releases the switch 60, the valve 56, being a spring-loaded valve, returns to the closed condition. Subsequently, the cam 36 momentarily operates the switch 58 to actuate the solenoid valve 54. Pressure is now applied to the lower portion of the cylinder 50 and a vent is provided for the upper portion of the cylinder. The extensible member therefore moves upwardly so as to be positioned for the next cutting stroke. The term chopper has been employed herein to denote that the cutting operation is cyclic in the sequence of the envelope machine and, at the speed of operation of conventional envelope stuffing machines, a chopping operation is performed by the cutting station.

Figure 3:
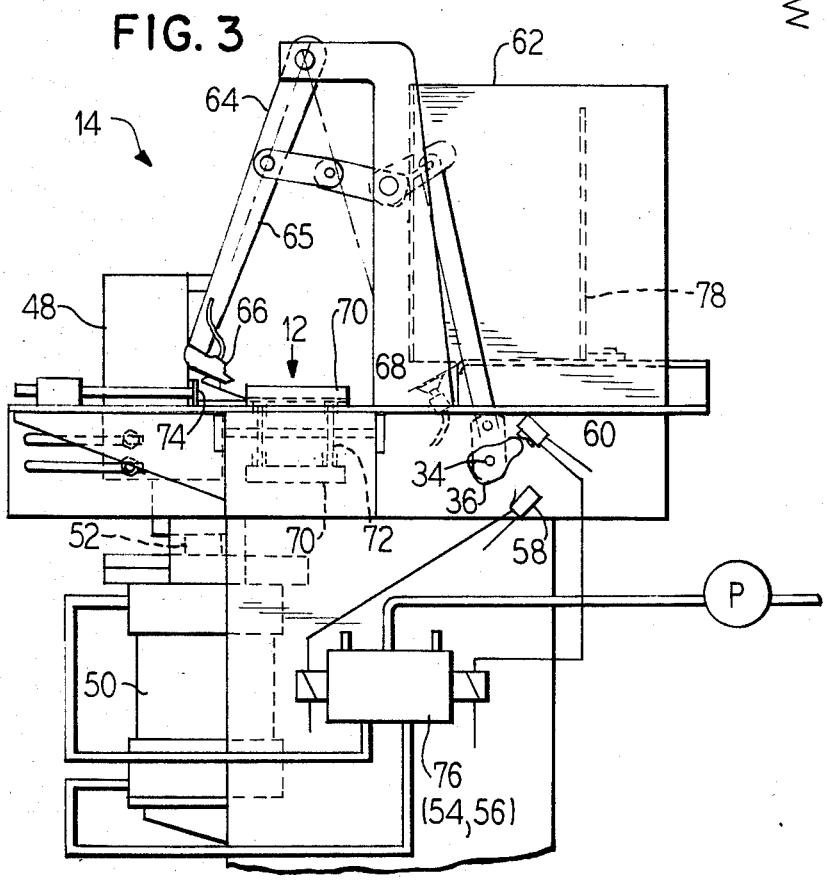
FIG. 3 is a right end view of the structure of FIG. 2.
Figures 2, 7, 8:
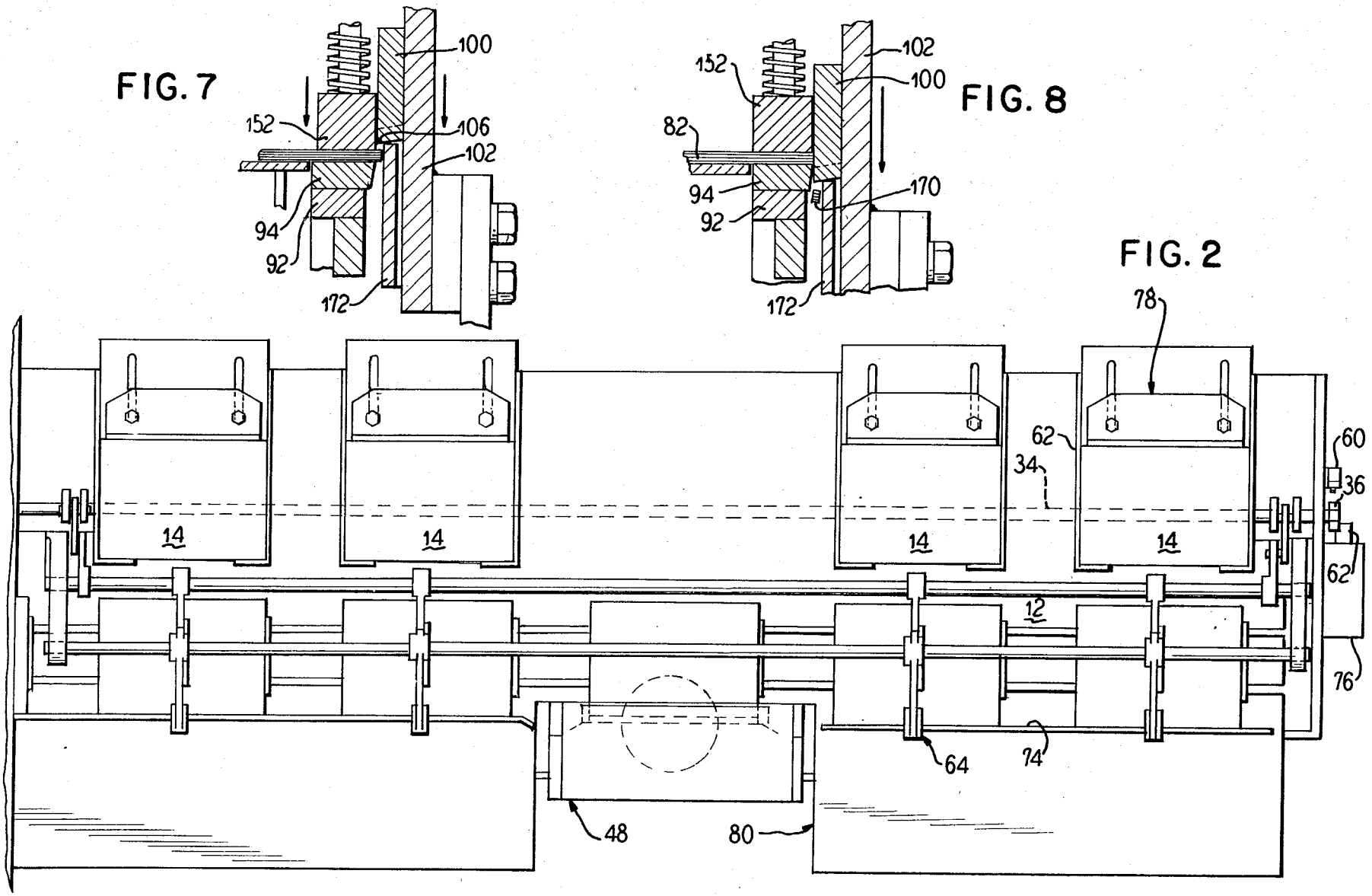
FIG. 2 is a schematic representation of a chopper and its physical relationship with respect to the conveyor and feed stations.
FIG. 7 is a partial sectional view of the holding and cutting structure immediately after cutting.
FIG. 8 is a partial sectional view of the holding and cutting structure immediately after cutting.

Referring to FIGS. 2 and 3, a brief discussion of the stuffing machine is provided for a better understanding of the stepping operation. A rotating shaft, which may be the shaft 34 or another shaft rotating in synchronism therewith, is connected to an eccentric rocker 64 for each insert feed station 14. A cyclic rocking action is therefore provided to an arm 65 which carries a suction head 66 for movement under the lowest insert stored in a bin 62, the lowest insert being pulled downwardly at its front edge by a suction head 68. The air-gripped insert is then moved out of the bin 62, the suction head 66 is inactivated, and the insert falls on a conveyor 12 which includes a central opening which receives the upper section of a chain/sprocket structure 72 carrying a plurality of dogs 70. The insert is positioned on the conveyor 12 between a pair of upstanding guides 74 (only one shown). The chain structure of the conveyor 12 is a ratchet-driven device in which the dogs 70 are advanced one station during one half of a cycle and the ratchet mechanism operates during the second half of the cycle. This provides the stepped movement of the inserts along the conveyor from station to station.

In FIG. 3 the mechanism for operating the chopper is also illustrated as having the cam 36 mounted on the shaft 34. As mentioned, this could be a separate, synchronously-operating shaft. As mentioned above, the cam 36 sequentially operates the switches 60 and 58 to activate respective solenoids of solenoid valves 54, 56 or a single double-acting valve 76 as an alternative, as indicated in FIG. 3.

Referring to FIG. 3, and to the right-hand insert feed station 14 of FIG. 2, each insert feed bin 62 is provided with an adjustable rear wall 78 for various widths of inserts and the table of the machine may be adjusted in the area of the conveyor for specific widths of inserts. Also illustrated in FIG. 2 is a recess 80 cut from the table of the machine for receiving the chopper of the present invention. This structure will be dealt with in greater detail with reference to FIGS. 4–8.

Figure 5:
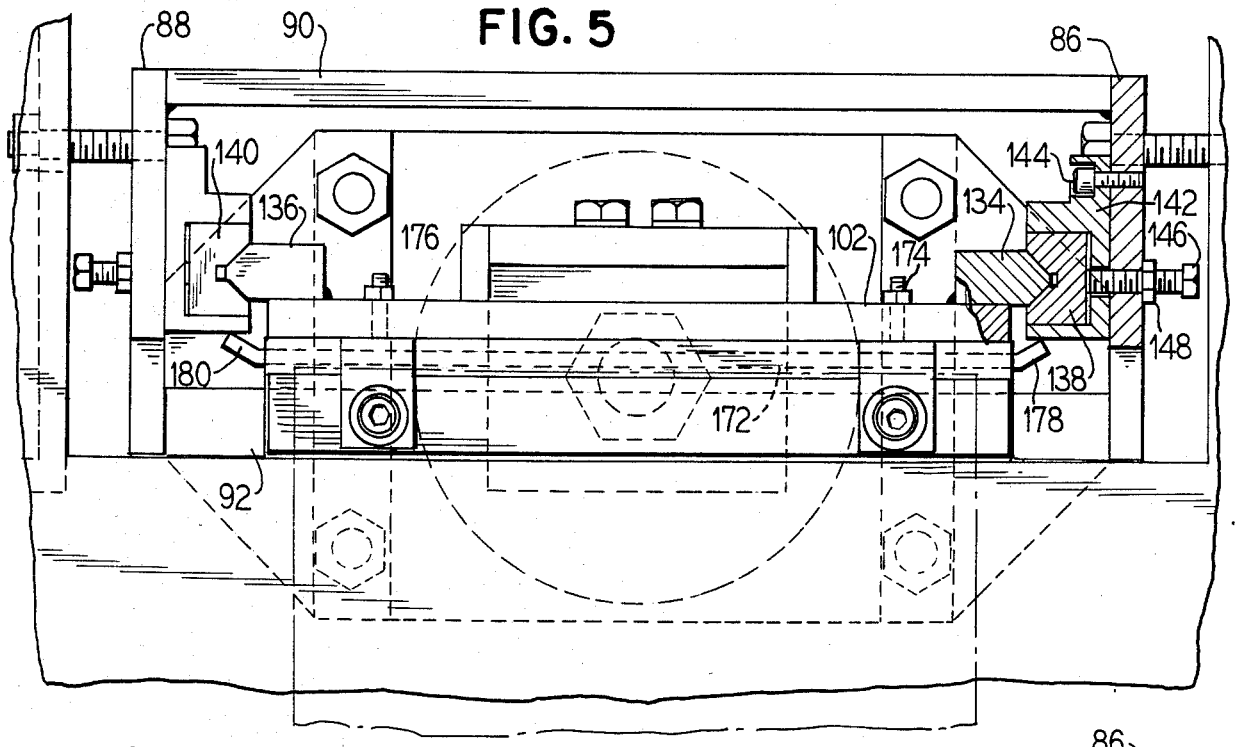
FIG. 5 is a top view of the chopper illustrated in FIG. 4.
Figure 4:
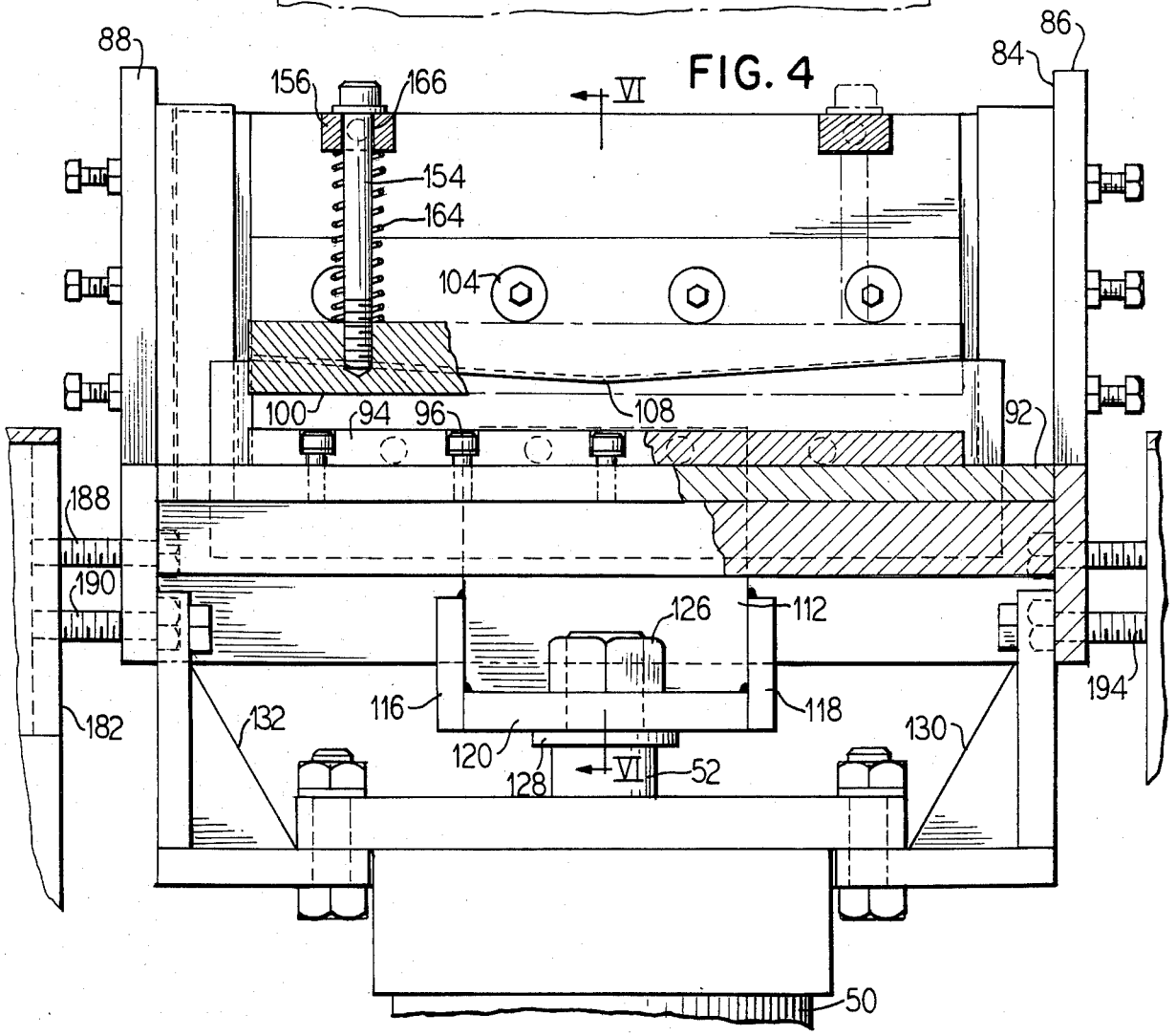
FIG. 4 is a front view of the chopper, shown attached to an envelope stuffing machine.
Figure 6:
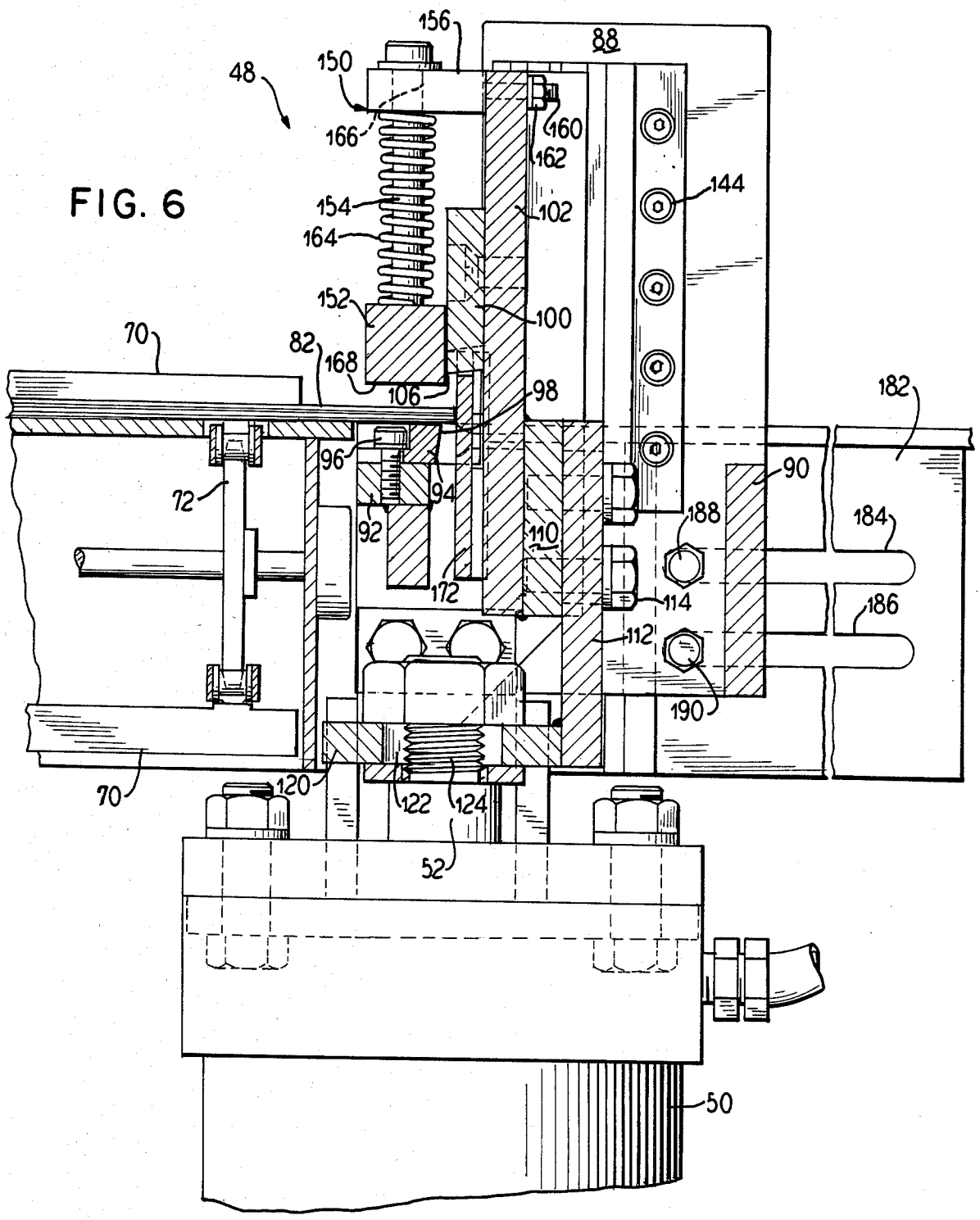
FIG. 6 is a sectional view taken along the line VI—VI of FIG. 4.

Referring to FIGS. 4–6, and in particular to FIG. 6, the chopper 48 is illustrated as comprising a frame 84 including a pair of vertical members 86, 88 and a cross member 90 connected therebetween. Another cross member 92 mounts a lower cutting blade 94 by way of a plurality of adjustable screws 96. The cutting blade 94 comprises a cutting edge 98 from which a bevel is provided, the bevel being, for example, 5°.

As is evident, the cutting blade 94 is a lower cutting blade and is fixed to the frame 84.

An upper cutting blade 100 is movably mounted as described hereinbelow. The upper cutting blade 100 is adjustably fixed, via screws 104, to a member 102. The upper cutting blade 100 has a cutting edge 106, which also is provided with a bevel of, for example, 5°. In addition, and as best seen in FIG. 4, the cutting blade 100 has a shallow V shape so as to provide a double shearing action of the insert from the center outwardly. The cutting "point" is referenced 108 in FIG. 4.

Referring in particular to FIGS. 4 and 6, the plate 102 is connected to a member 112 with a spacer 110 therebetween, the connection being made by way of adjustable screws and vertical slots in the member 112. As best seen in FIG. 4, the plate 112 is connected to a pair of members 116, 118 having a cross member 120 therebetween. The member 120 includes a bore 122 therethrough for receiving a threaded end 124 of the extensible member 52. The extensible member is then secured to the member 120 by way of a nut 126 and a flange 128 carried by the extensible member. The cylinder 50 is fixed to the frame 84 by way of a pair of L-shaped structures 130, 132.

Referring in particular to FIG. 5, the plate 102, at its outboard edges, carries a pair of vertical bearings 134, 136 which are received in respective bearing guides 138, 140. Inasmuch as this structure is symmetrical with respect to the entire chopper, only the right-hand side will be discussed in detail. The bearing guide 138 is held in a guide holder 142 is adjustably mounted to the upright member 86 by way of a plurality of screws 144. The bearing guide 138 may be adjusted toward and away from the bearing 134 by way of a plurality of lockable adjustment screw/nut combinations 146, 148. It is therefore readily apparent that downward movement of the extensible member 52 causes a downward movement of the upper cutting blade 100 via the linkage of elements 110, 112, 116, 118, 120, 124, 126, 128. It is therefore readily apparent that the upper cutting blade 100 is moved downwardly towards the lower cutting blade 94.

Inasmuch as it desirable to firmly hold the insert booklet during cutting, a particular feature of the invention provides a holding mechanism which operates to hold the insert prior to cutting, during cutting and during release. This mechanism is collectively referenced 150 and is illustrated as comprising a cross member 152 which is mounted on a pair of adjustable studs 154 carried by a member 156 which is secured to the plate 102 as by a threaded stud 160 and a nut 162. A spring 164 bears against the upper surface of the member 152 and the lower surface of the member 156. The member 156 includes a bore for slidably receiving the stud 154 therethrough. As is apparent, and with particular reference to FIG. 6, the lower surface 168 of the member 152 is below the cutting edge 106 of the upper cutting blade 100 and as the plate 102 moves the cutting plate 100 downwardly, the member 152 moves downwardly in advance of the cutting edge to grip the booklet 82 against the upper surface of the lower cutting blade 94. As the plate 102 carries the upper cutting blade 100 downwardly to engage the booklet 82, the studs 154 have a relative upward movement through the bores 166 and the spring 164 is compressed. During the reverse or release operation, with the plate 102 and blade 100 moving upwardly, the springs 164 release their stored energy to maintain the member 152 in contact with the booklet until the cutting edge 106 has cleared the upper surface of the booklet. The cyclic movement for the cutting operation is, as specifically set forth above, controlled by the cyclic rotation of the cam 36 and the operation of the valves 54, 56 (76).

FIG. 7 illustrates the holding operation during the down stroke prior to cutting, while FIG. 8 illustrates the relative positions of the elements immediately after cutting off the edge 170.

In order to define the depth of cut, a stop 172 is secured to the plate 102 immediately below the upper cutting blade 100. The stop 172 is adjustably, as best seen in FIG. 5, by way of a pair of fasteners 174, 176. In order to prevent snagging of the insert booklet as it is stepped into the chopper and in order to prevent snagging as the booklet is stepped out of the chopper, the stop 172 is provided with bent ends 178, 180 which extend away from the path of travel of the insert booklet.

All of the elements mentioned thus far which are secured by screws and the like are adjustably mounted. The same holds true for the entire chopper with respect to the stuffing machine. The following structure is provided on both sides of the chopper, but only one side is illustrated in FIG. 6. Referring to FIG. 6, each side of the recess 80 (FIG. 2) is provided with a mounting plate 182 for mounting the chopper therebetween. The mounting plate 182 includes a pair of elongate slots 84, 86 for receiving bolts 188, 190 therethrough for adjustably mounting the chopper toward and away from the conveyor. The bolts 188, 190 on the one side of the chopper may be advanced or retracted along with a similar action of the bolts 192, 194 on the opposite side of the chopper so as to position the chopper along the direction of travel of the conveyor.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In an envelope stuffing machine of the type including means for stuffing insert stacks formed by a cyclic stepping operation by means for moving individual insert sheets onto a stepping conveyor from respective insert sheet feed bins located at feed stations along the conveyor to form said insert stack means for moving said insert stack onto the stuffing station means to feed envelopes from an envelope feed bin to the stuffing station, a stuffing mechanism including means to open the envelope and to stuff the envelope with the insert stack, means to convey the stuffed envelope from the stuffing station, and synchronization means to control the feeding, conveying and stuffing means, the improvement therein for handling multisheet inserts which are intially joined at an edge to form a booklet, comprising:

one of said insert feed bins including means to grasp and feed the booklets one at a time onto the stepping conveyor;

a cutter located at one of the feed stations for receiving each booklet and operable to cut off the joined edge prior to moving said insert stack onto said stuffing station; and cutter control means connected to said cutter and connected to and controlled by the synchronization means to control operation of the cutter in accordance with the stepped operation of the stuffing machine thereby stuffing the initially joined insert stack in an unjoined state.

2. The improved envelope stuffing machine of claim 1, wherein said cutter comprises:

first and second cutting blades, said first cutting blade fixed and said second cutting blade movably mounted; and drive means connected to said second cutting blade and connected to and operated by said cutter control means.

3. The improved envelope stuffing machine of claim 2, wherein said cutter further comprises:

clamping means fixedly mounted with said second cutting blade and cooperable with said first cutting blade to clamp a booklet therebetween.

4. The improved envelope stuffing machine of claim 2, wherein said cutter further comprises:

a fixed stop to engage a booklet and define the depth of cut with respect to the joined edges.

5. The improved envelope stuffing machine of claim 2, wherein said cutter further comprises:

bearings mounted on said second cutting blade; and a frame comprising bearing slides slidably receiving said bearings.

6. The improved envelope stuffing machine of claim 1, wherein said cutter control means comprises:

a fluid actuated cylinder including first and second fluid connections and an extensible member connected to said second cutting blade; and cylinder operating means comprising a rotating spindle on said machine rotating in accordance with the machine cycle;

electrically-operated valve means connected between said first and second fluid connections and a fluid supply;

switch means connected to said valve means and to an electrical supply; and switch operating means carried by said rotating spindle to cyclically operate said switch means in accordance with the machine cycle.

7. The improved envelope stuffing machine of claim 6, wherein:

said switch means comprises first and second switches; and said switch operating means comprises a cam.

8. The improved envelope stuffing machine of claim 6, wherein:

said fluid actuated cylinder comprises a compressed air operated cylinder.

9. The improved envelope stuffing machine of claim 3, wherein said clamping means comprises:

a spring-loaded member above said first cutting member for yieldably engaging a booklet.

10. The improved envelope stuffing machine of claim 1, wherein said cutter comprises:

a frame including a pair of side members connected to the stuffing machine;

a pair of bearing guides carried on respective side members;

first and second cutter assemblies;

said first cutter assembly fixed to said frame between said side members and including a first cutting blade; and said second cutter assembly comprising a second cutting blade cooperable with said first cutting blade, a fixedly-mounted fluid operated cylinder connected to said cutter control means and including an extensible member, a plate connected to said extensible member and carrying said second cutting blade, and a pair of bearings mounted on said plate and slidably received in respective bearing guides.

11. The improved envelope stuffing machine of claim 10, wherein said cutter further comprises:

a stop mounted on said plate adjacent said second cutting blade to define the depth of cut.

12. The improved envelope stuffing machine of claim 10, wherein said cutter further comprises:

adjustable means mounting said plate to said extensible member to adjust the booklet thickness.

13. The improved envelope stuffing machine of claim 10, and further comprising:

adjustable means mounting said frame side members to the stuffing machine to adjust said cutter with respect to the conveyor.

14. The improved envelope stuffing machine of claim 10, wherein said cutter further comprises:

holding means mounted on said plate to urge and hold a booklet against said first cutting blade prior to engagement of the booklet by said second cutting blade.

15. The improved envelope stuffing machine of claim 14, wherein said holding means comprises:

a bar extending along and parallel to the conveyor;

at least one first member extending from said plate and including an aperture therethrough;

at least one second member connected to said first member and extending through said aperture; and at least one spring engaging said first member and said bar and urging said bar away from said first member.

16. The improved envelope stuffing machine of claim 15, wherein:

said second member comprises adjustment means for adjusting the spring force.

17. The improved envelope stuffing machine of claim 14, wherein:

said first cutting blade and said holding means each comprise a flat surface facing the like flat surface of the other.

18. The improved envelope stuffing machine of claim 10, wherein:

said first cutting blade comprises a flat surface for receiving a booklet thereon; and a surface angled from said flat surface and together with said flat surface, defining a first cutting edge.

19. The improved envelope stuffing machine of claim 10, wherein said second cutting comprises a V-shaped cutting edge as viewed perpendicular to the length of said second cutting blade.

20. In a method of stuffing envelopes with insert stacks of a plurality of unjoined sheets, in which the sheets are moved onto a conveyor path from respective insert bins to form said stacks and stepped along the conveying path to a stuffing station and in which the sheets are stuffed into an envelope which is fed to the stuffing station from an envelope bin, the improvement comprising: providing a stuffing insert of a predetermined number of insert sheets including a predetermined sheet sequence in the form of a booklet of such sheets joined along one edge, comprising the steps of:

sequentially moving said multisheet booklets onto the conveying path;

stepping the booklets along the path;

sequentially receiving the booklets at a cutter and cutting off the joined edges of the sheets to form a stack of unjoined insert sheets;

stepping the multisheet insert stacks to a stuffing station; and sequentially stuffing envelopes with respective multisheet insert stacks with said sheets being in an unjoined state.

* * * * *